US007657966B1

(12) United States Patent
Schwartz

(10) Patent No.: US 7,657,966 B1
(45) Date of Patent: Feb. 9, 2010

(54) CLEAN EXHAUST AIR UPRIGHT VACUUM

(76) Inventor: Barry R. Schwartz, 12846 Hampton Lakes Cir., Boyton Beach, FL (US) 33436

( * ) Notice: Subject to any disclaimer, the term of this patent is extended or adjusted under 35 U.S.C. 154(b) by 0 days.

(21) Appl. No.: 11/761,277

(22) Filed: Jun. 11, 2007

(51) Int. Cl.
*A47L 9/10* (2006.01)

(52) U.S. Cl. ..... 15/324; 15/331; 15/334; 15/327.2; 15/351; 15/352

(58) Field of Classification Search ..... None
See application file for complete search history.

(56) References Cited

U.S. PATENT DOCUMENTS 2,295,981 A * 9/1942 White ..... 55/368
4,171,553 A 10/1979 Stein
4,955,106 A 9/1990 Stein et al.
5,056,175 A 10/1991 Stein et al.
5,228,169 A 7/1993 Stein et al.
5,255,410 A 10/1993 Stein et al.
5,560,074 A * 10/1996 Graham et al. ..... 15/323
5,819,370 A 10/1998 Stein
2003/0131439 A1 * 7/2003 Wen ..... 15/344
2005/0000054 A1 * 1/2005 Ninomiya et al. ..... 15/347
2007/0289088 A1 * 12/2007 Mayes et al. ..... 15/352

* cited by examiner

*Primary Examiner*—David A Redding
(74) *Attorney, Agent, or Firm*—Rick Martin; Patent Law Office of Rick Martin, P.C.

(57) ABSTRACT

An upright bypass type vacuum base section pulls from a suction chamber surrounding the bag.

13 Claims, 10 Drawing Sheets

CLEAN EXHAUST AIR UPRIGHT VACUUM

FIELD OF INVENTION

The present invention relates to an upright vacuum that draws suction from more than one side of the bag and cleanses the exhaust air using UV light and/or ionization and/or silver nitrite treatment.

BACKGROUND OF THE INVENTION

Traditional upright vacuums using a bypass suction with a disposable fiber bag draw suction from under the bag. Thus, as dirt accumulates in the bottom of the bag, the motor has to pull suction through the accumulated dirt. A loss of suction at the inlet head results. As the bag fills, the cleaning efficiency at the inlet head decreases.

Some bypass type vacuum cleaners draw suction from one side of the bag instead of the bottom. Examples of such vacuums include Sebo models X1 and X4 and Riccar Radiance and Simplicity Synergy (D527,5055, D515,4345). These vacuum cleaners should maintain their cleaning efficiency as the bag fills.

What is needed in the art is a bypass vacuum system that pulls suction from at least two sides of the bag. Also needed in the art is an exhaust air sanitizing system to return sanitized air to the user's environment.

The present invention provides suction from three sides of the bag. A side door also has an accordion shaped back segment to improve suction. Upon removal of the bag, the bag is closed to prevent dust from escaping into the user's environment.

The sanitizing of the exhaust air system has a UV light and radiant catalytic ionization unit, trademark of Ecoquest, Greeneville, Tenn. It can also include a silver nitrate antimicrobial liner and/or impregnation in the bag. It can also include a silver nitrate impregnated and/or lined exhaust air filter.

SUMMARY OF THE INVENTION

An aspect of the present invention is to provide suction around three sides of a bag in a bypass vacuum cleaner to increase suction at the inlet head.

Another aspect of the present invention is to provide a side door for the bag replacement process.

Another aspect of the present invention is to provide an accordion side along at least one side of the bag to increase suction.

Another aspect of the present invention is to provide a bag with a flat and/or at least one accordion side for increased suction.

Another aspect of the present invention is to provide an exhaust cleaning system with a UV light and/or an ionization generator and/or a silver nitrate lining (or impregnation) in the bag and/or a silver nitrate impregnated and/or lined exhaust filter.

Other aspects of this invention will appear from the following description and appended claims, reference being made to the accompanying drawings forming a part of this specification wherein like reference characters designate corresponding parts in the several views.

The upright vacuum cleaner has three positions. Straight up allows the user to use the wand feature for above floor cleaning. Tilted back provides the floor cleaning ability using the powered roller brush. Flat down allows the powered roller brush base to slide under beds, furniture, and other items in the home.

In the bypass air system the motor/blower is mounted in the base. It sucks air from three sides of the bag. The bag is supported in a plastic case that has an exhaust channel. A UV light and ionization generator is mounted in the exhaust channel.

To further sanitize the exhaust air a silver nitrate is impregnated and or lined in the bag, or a liner is provided with this or another antimicrobial treatment. Finally, the exhaust air passes out the base through a replaceable filter which also may be impregnated and/or lined with an antimicrobial such as silver nitrate.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
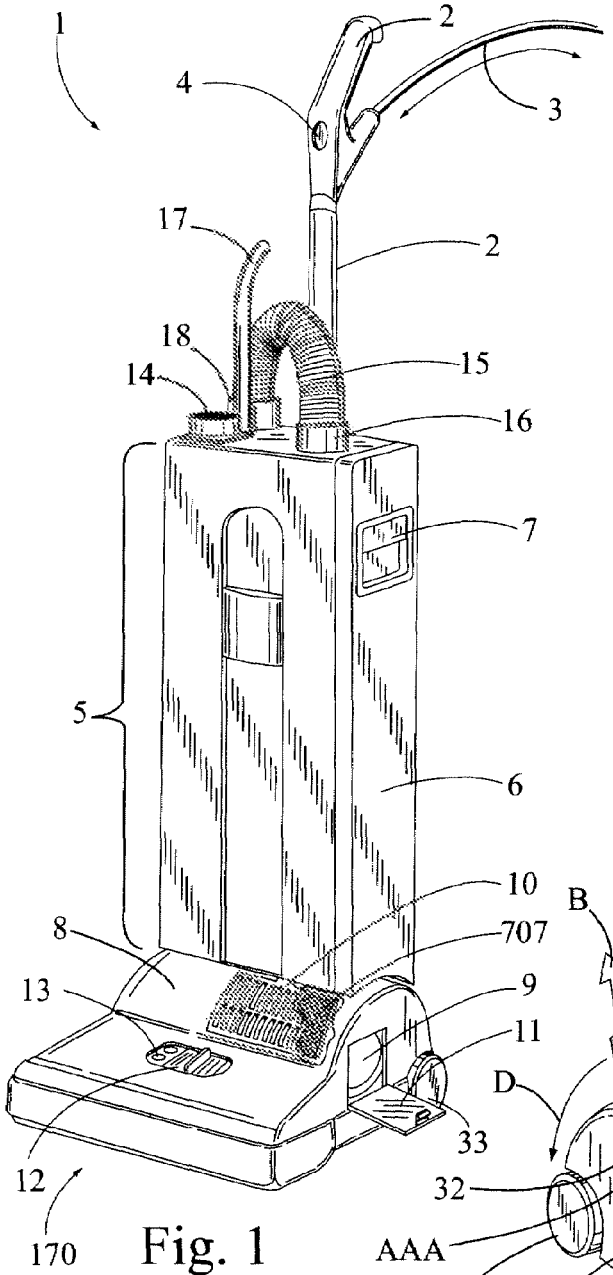
FIG. 1 is a front perspective view of the preferred embodiment vacuum cleaner.

FIG. 1 shows an upright vacuum cleaner 1 having a handle 2 shown in the upright position. The A/C power cord 3 and ON/OFF switch 4 are shown. The bypass air chamber 5 has a side door 6 with door handle 7. The hood and base 8 has a conventional blower/motor 9 located behind the exhaust outlet 10.

Exhaust air filter 707 may be treated with silver nitrate. An optional base access door 11 allows additional access to the blower/motor 9 and powered brush roller assembly 20 shown in FIG. 3. An LED roller stop light and/or raise/lower brush roller light 13 is next to indicator lights 12 showing brush roller status and bag full.

A UV light/ionization generator 14 is located in the exhaust channel C1, C2, C3 (FIG. 2 and FIG. 4) of the bypass chamber 5. The wand/coupling 18 has a handle 17. The vacuum hose 15 and coupling 16 conveys the dirt/dirty air (FIGS. 2 and 3) from the inlet head 170 to the bypass chamber 5.

Figure 2:
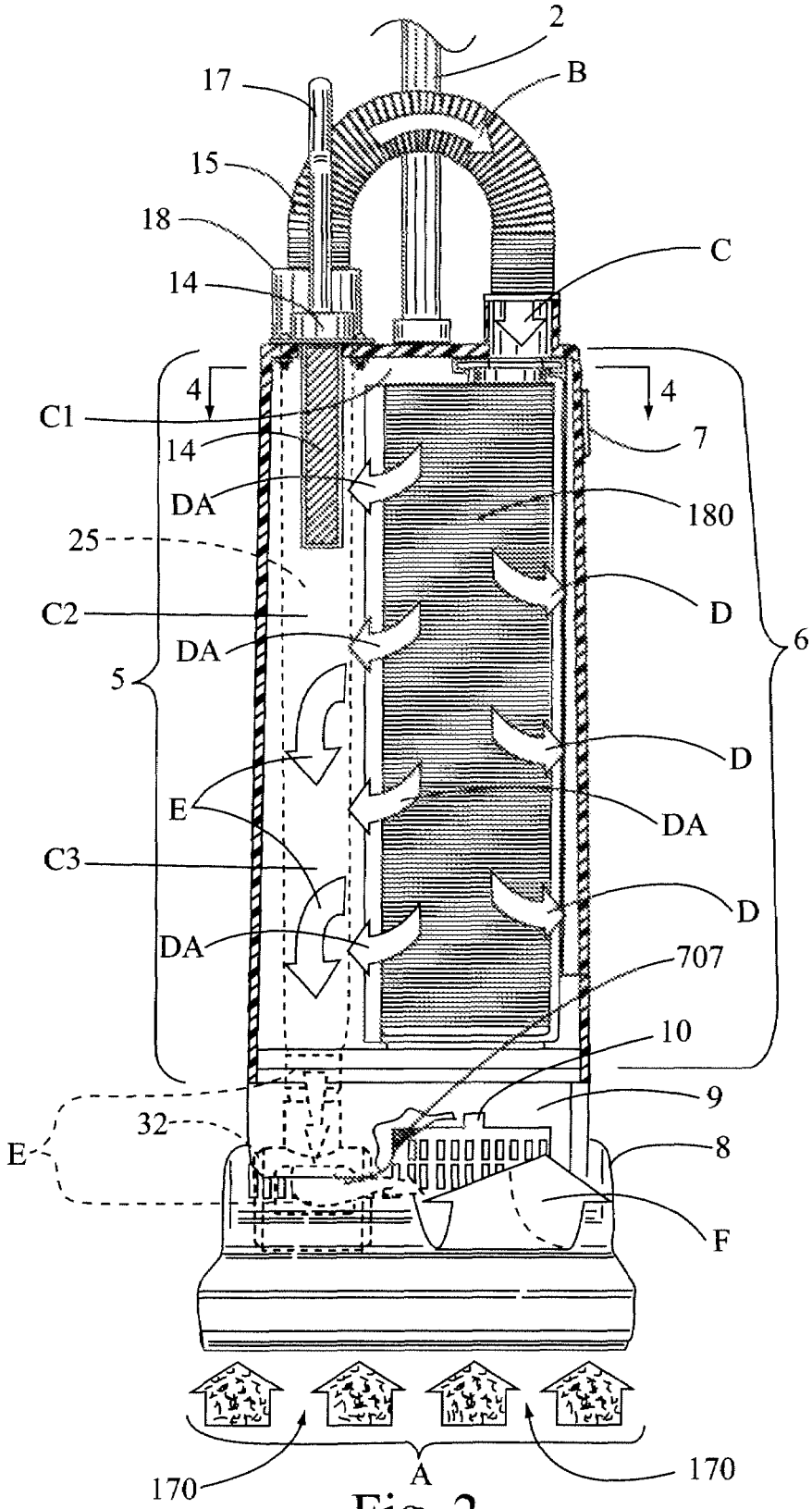
FIG. 2 is a front plan view of the FIG. 1 embodiment with the bypass airflow section shown in a cross sectional view.

Referring next to FIG. 2 the dirty air is represented by arrows A. Via suction of the bypass system well known in the art, the dirty air travels in the inlet head 170, up through the lower half of diverter valve 32, arrows AA and AAA (FIG. 2), up the wand 25 and wand coupling 18 through hose 15 as seen by arrow B, into the bag 180 as seen by arrow C, then out the bag 180 as seen by arrows D, DA. The dirt falls into the bottom of the bag 180. Most of the exhaust air from the bag 180 flows as shown by arrows DA into an exhaust channel C1, C2, C3. In this exhaust channel C1, C2, C3 is located the UV light/ionizer 14. The exhaust air, arrows E, flows from the exhaust channel C1, C2, C3 through the blower/motor 9 and out the exhaust outlet 10 as seen by arrow F.

Figure 3:
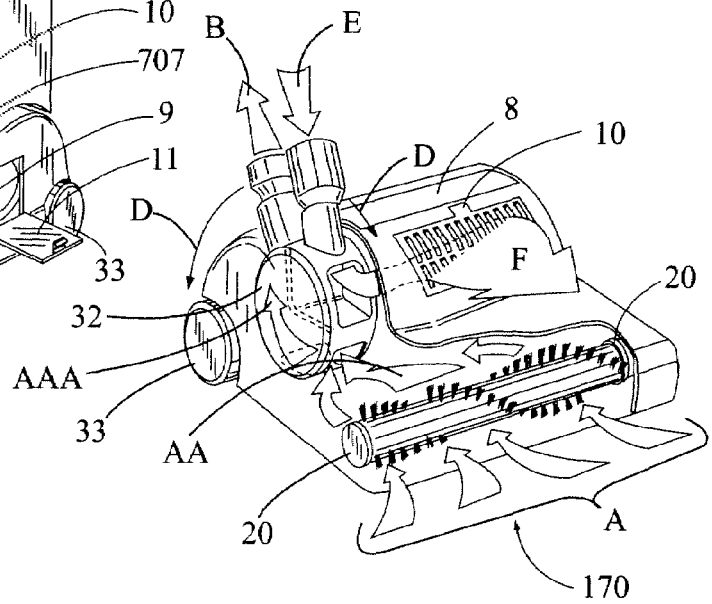
FIG. 3 is a top perspective view of the powered brush roller base.
Figure 6:
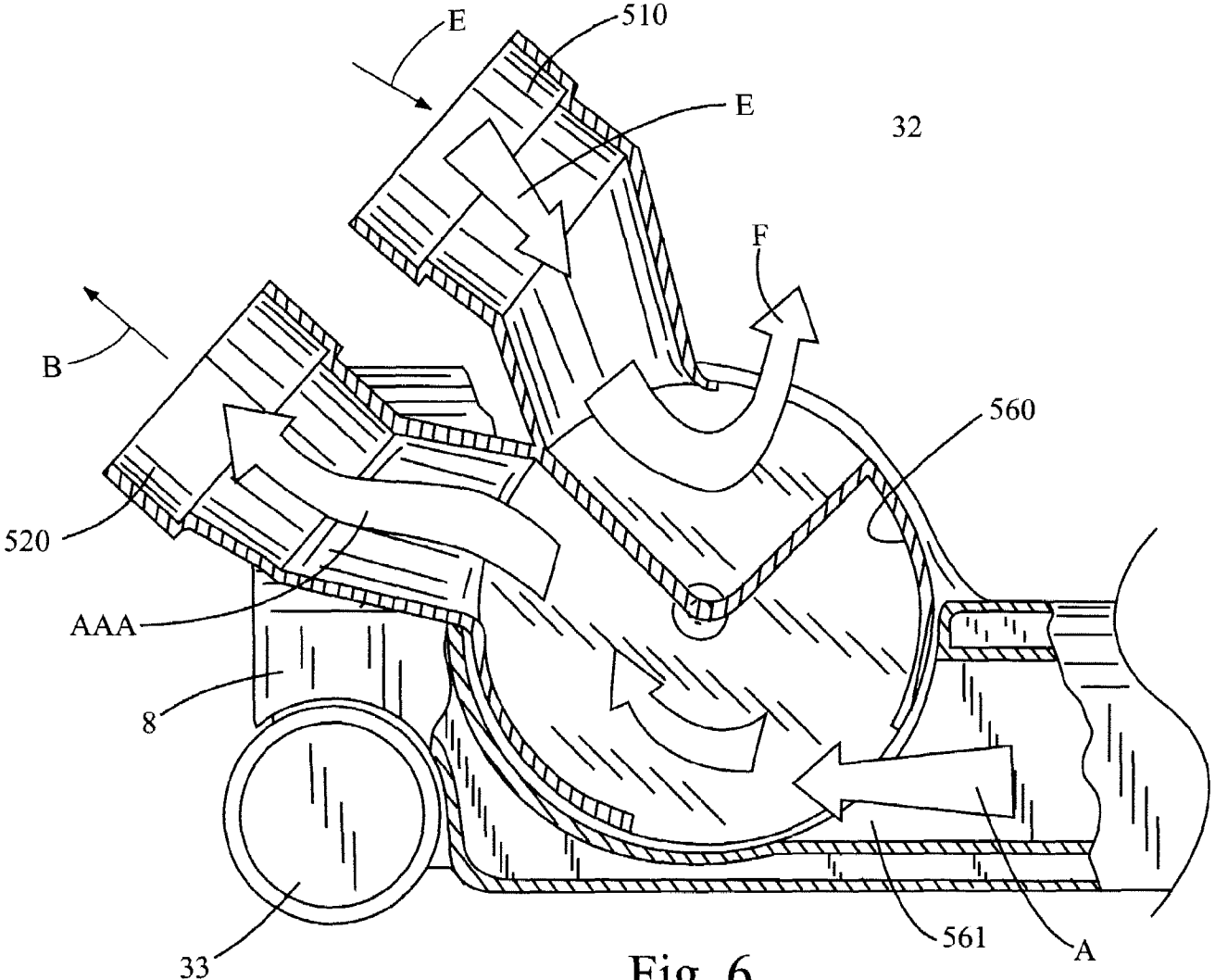
FIG. 6 is a left side plan view of the base in partial cutaway, with the conducting valve in the tilted back position for floor cleaning.

Referring next to FIG. 3 the base/hood 8 has rear wheels 33 and has a powered brush roller 20. The dirty air is diverted from arrows A to AA and into divided diverter valve 32 as seen by arrow AAA, and up the wand 25 (FIG. 2, FIG. 4, and FIG. 8), to the hose 15 (FIG. 1 and FIG. 2), as seen by arrow B only when the handle 2 is in the tilt or flat position as shown in FIGS. 6 (tilt) and 7 (flat). FIG. 3 shows the diverter valve 32 in the tilt position used for vacuuming the floor. Note how exhaust air arrow E is a continuation of arrow E from FIG. 2.

Figure 4:
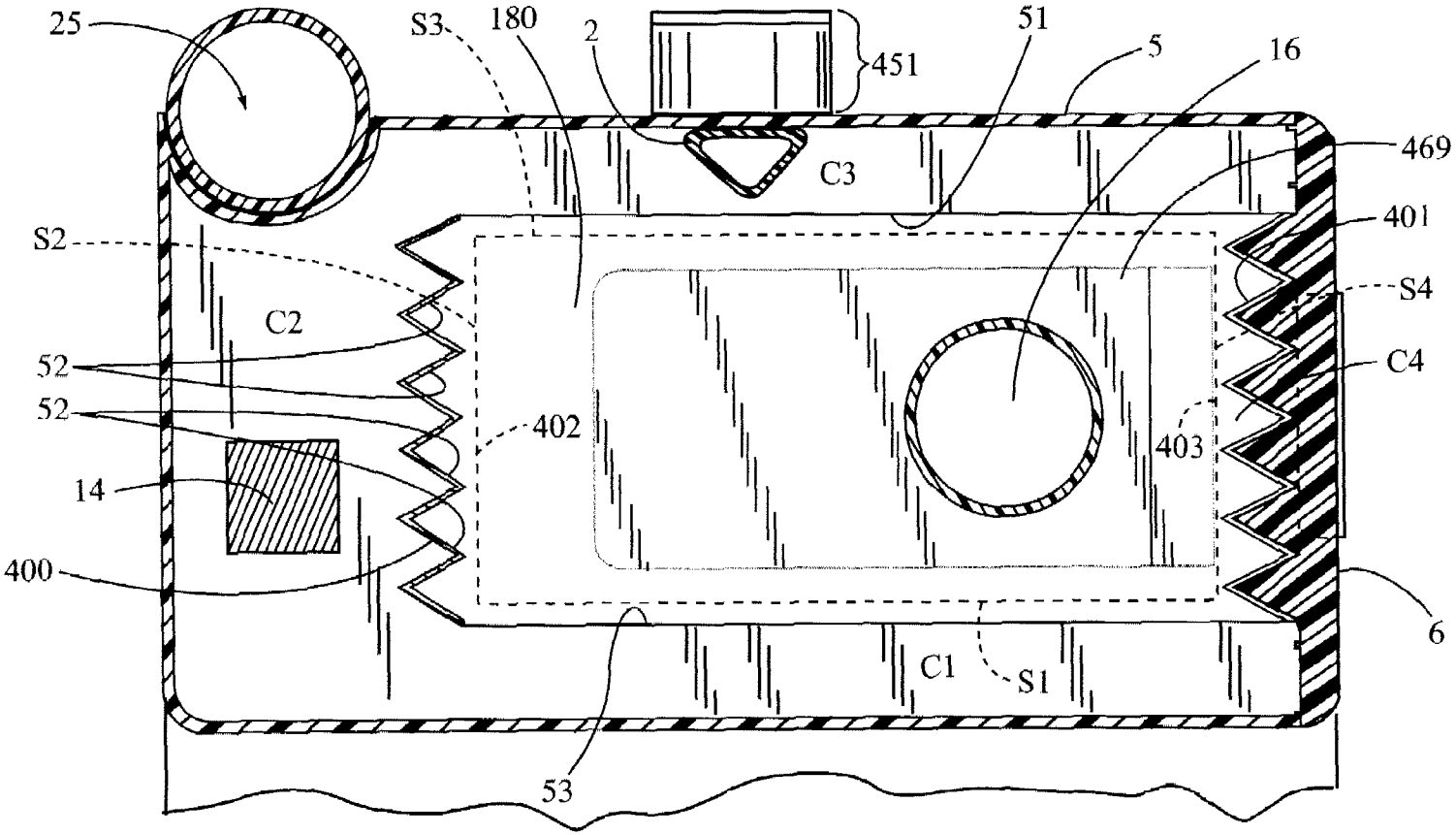
FIG. 4 is a cross sectional view taken across the top of the bypass airflow system.

Referring next to FIG. 4 the standard bag 180 is surrounded on two sides with accordion shaped walls 400, 401. The door 6 has inside shape 401 of an accordion. These accordion shapes increase the suction area along the sides 402, 403 of the bag 180.

The bag 180 with sides S1, S2, S3, S4 is surrounded on three sides 51, 52, 53 with a suction chamber segment C1, C2, C3, thereby maximizing the suction thru the bag 180 even as it fills with dirt. Further suction is gained with accordion wall 401 forming suction chamber segment C4 even on the fourth side S4 of the bag 180. Segments C1, C2, C3 form a C shaped and or U shaped suction area around bag 180.

The wand 25 is shown. A power cord wrap 451 is shown. A (metal) handle 2 tube segment is shown. The UV light/ionizer 14 is powered by 110 V A/C. It is preferably a DuctworX™ RCI unit by Ecoquest International, Greeneville, Tenn., and or comparable unit. A plastic bag collar 469 can slide over the collar opening 16 to prevent dust from escaping as the side door 6 is opened and the bag 180 replaced. The bag 180 may have impregnation of silver nitrate as an antimicrobial and/or an antimicrobial liner (including silver nitrate). Preferably the exhaust filter 51, 52, 53 is made of 3M® Filtrete Micron filter media, it can be of a rectangular shape, and/or the shape of walls 51, 400 and 53.

Figure 5:
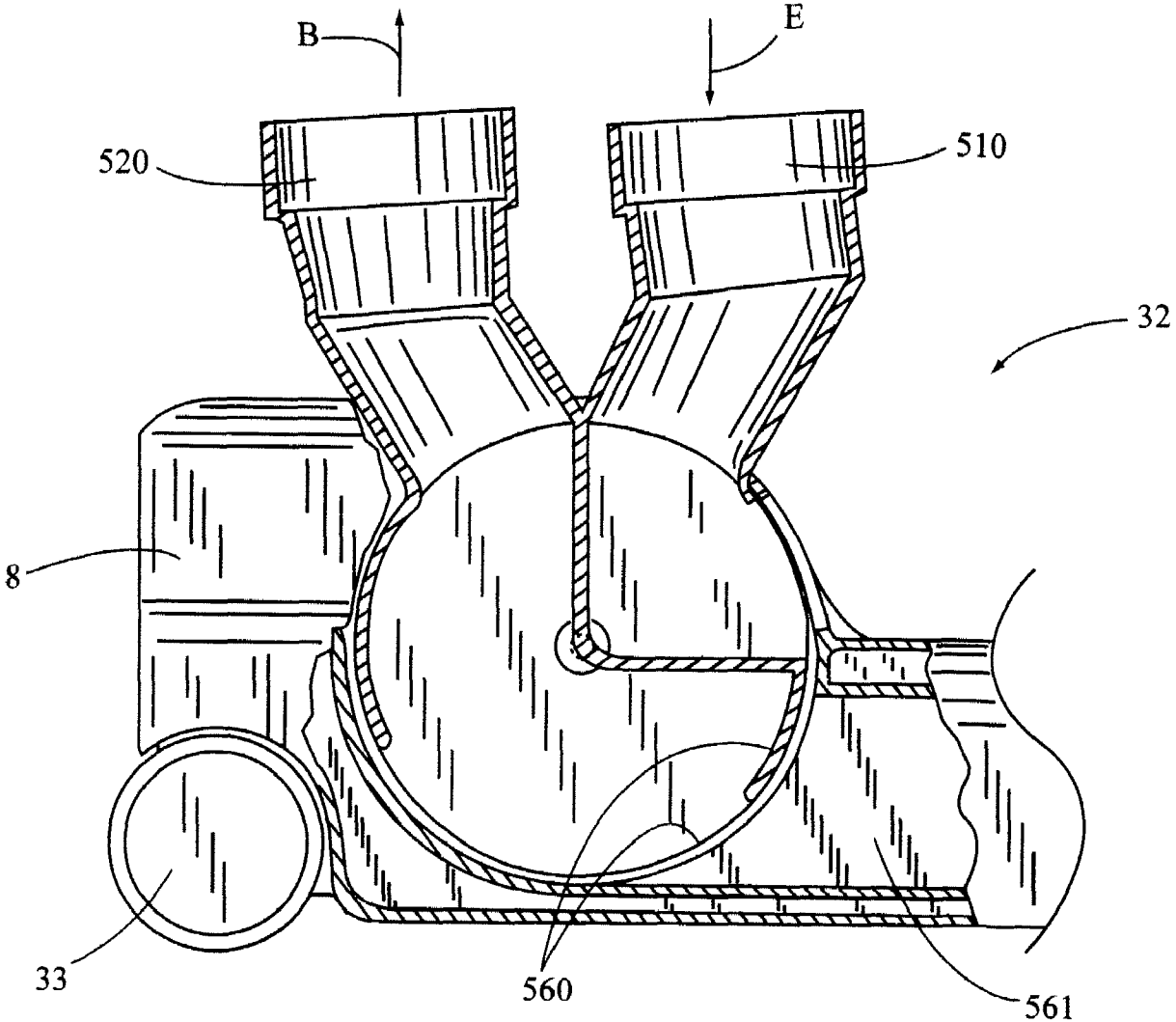
FIG. 5 is a left side plan view of the base in partial cutaway, with the conducting valve in the upright position for wand use.

In FIG. 5 the diverter valve 32 is in the upright position for wand 25 use, with the chamber 5 and wand removed for illustration purposes. The internal baffle segment 560 has closed off the dirty air inlet 561. Thus, port 520 is inactive allowing suction for wand 25 (removed) for above the floor cleaning. All the suction is diverted to port 510 which connects to suction chamber C1, C2, C3 (FIG. 4).

FIG. 6 shows the tilt position described in FIG. 3. Baffle 560 has moved up opening part 561.

Figure 7:
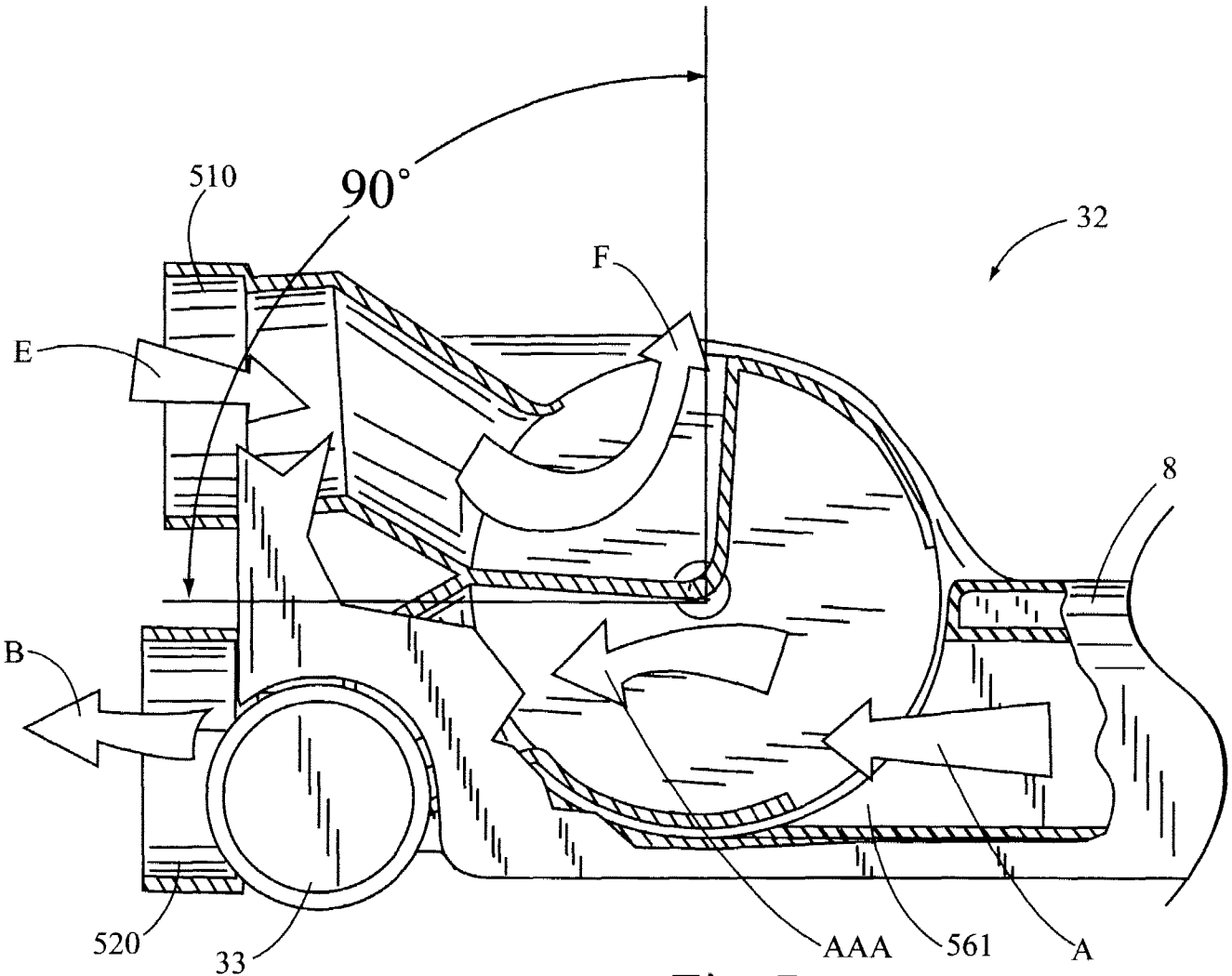
FIG. 7 is the same view as FIG. 6 with the handle flat down for going under furniture.

FIG. 7 shows angle ANG as 90°, wherein the handle 2 is flat toward the ground to get under furniture, arrow F flow passes through the suction motor blower before exiting to ambient.

Figure 8:
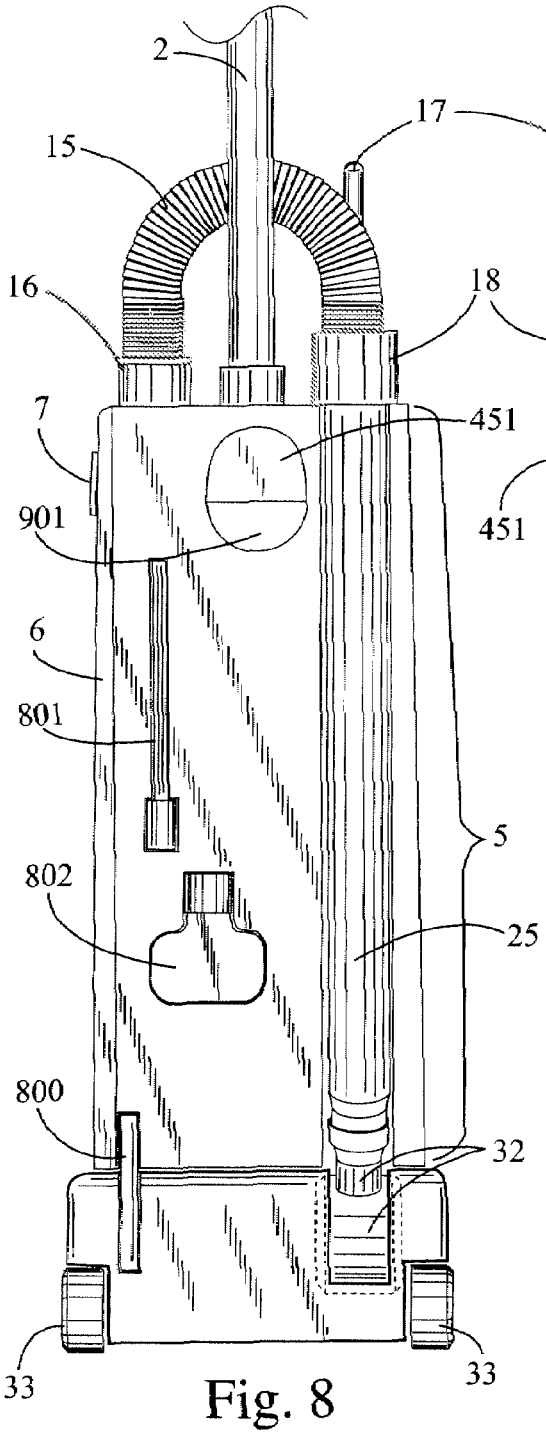
FIG. 8 is a rear plan view of the FIG. 1 embodiment.
Figure 9:
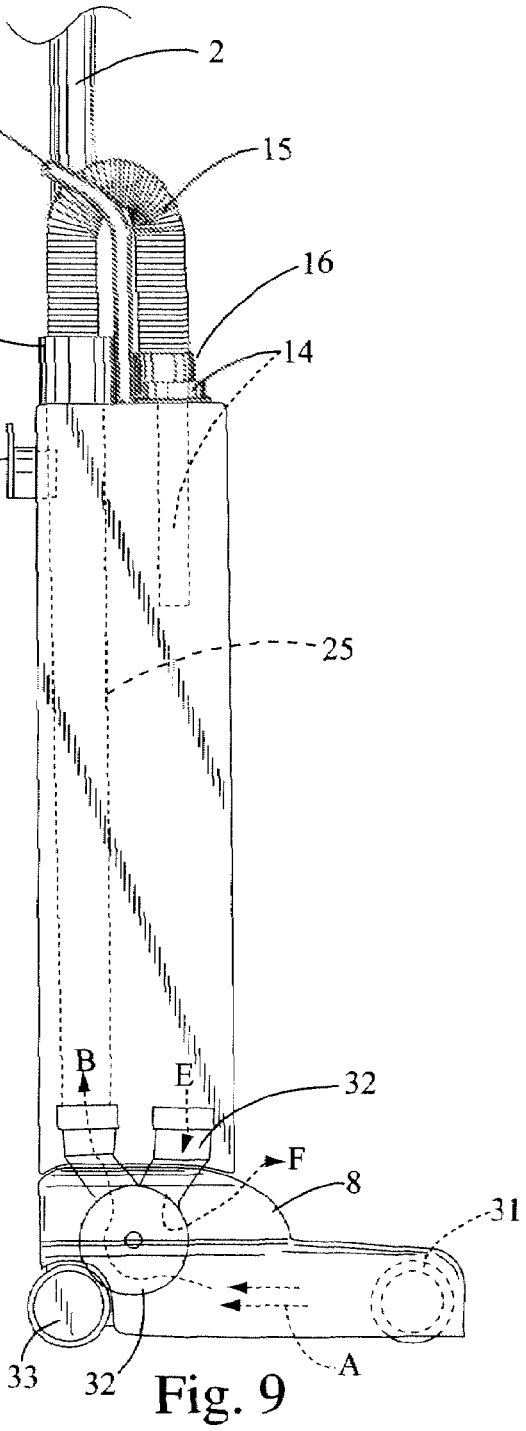
FIG. 9 is a left side plan view of the FIG. 1 embodiment.

FIGS. 8, 9 show a support hinge 800 for the chamber 5, a crevice tool 801 mounted in its recess, a furniture tool 802 mounted in its recess, and cord wrap 451 in the up position. A vacuum grab opening 901 is shown.

Figure 10:
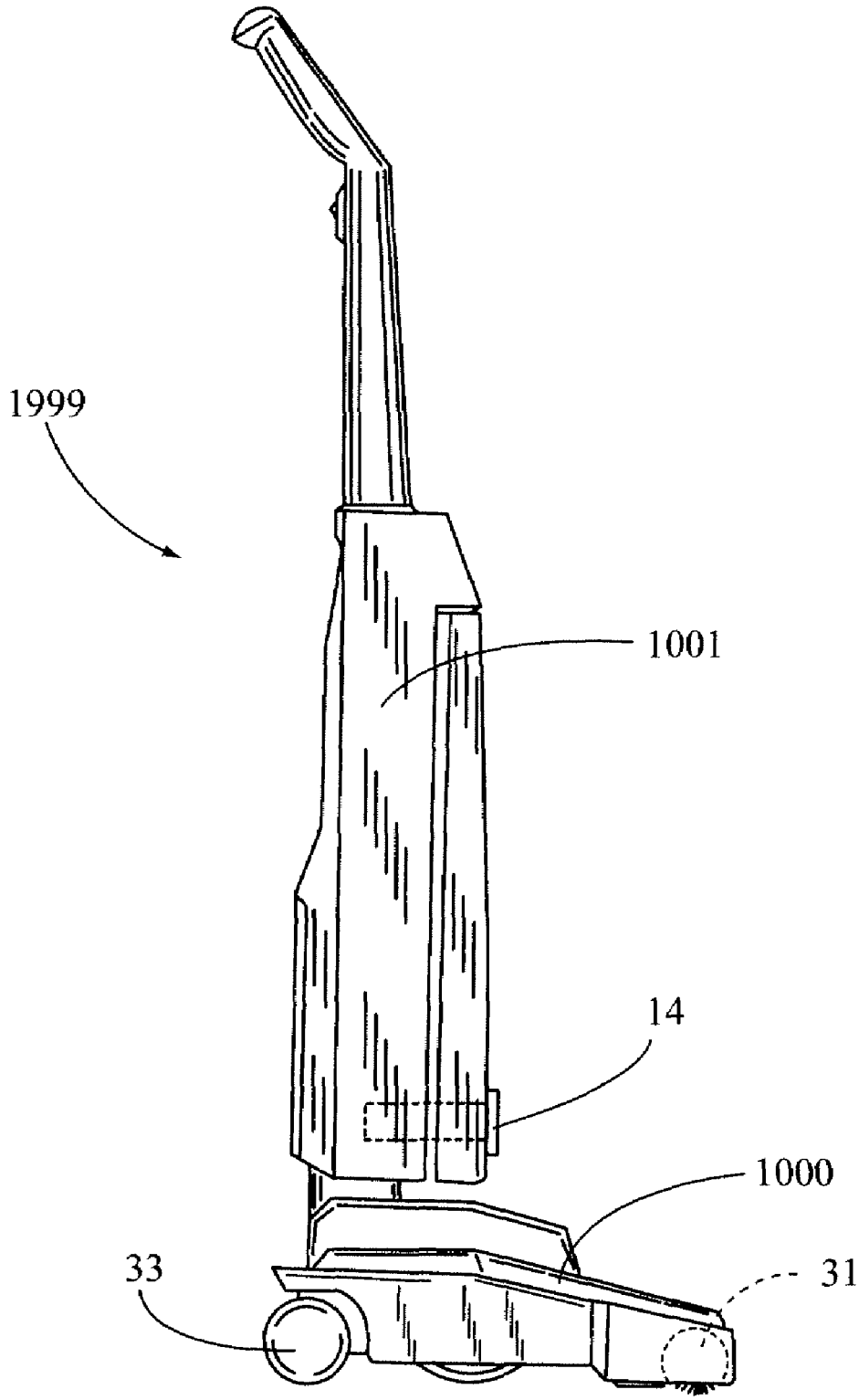
FIG. 10 is a side view of an alternate embodiment fan first suction type upright having a UV light and/or ionization generator and/or antimicrobial filter exhaust filter exhaust in cleaning system.
Figure 11:
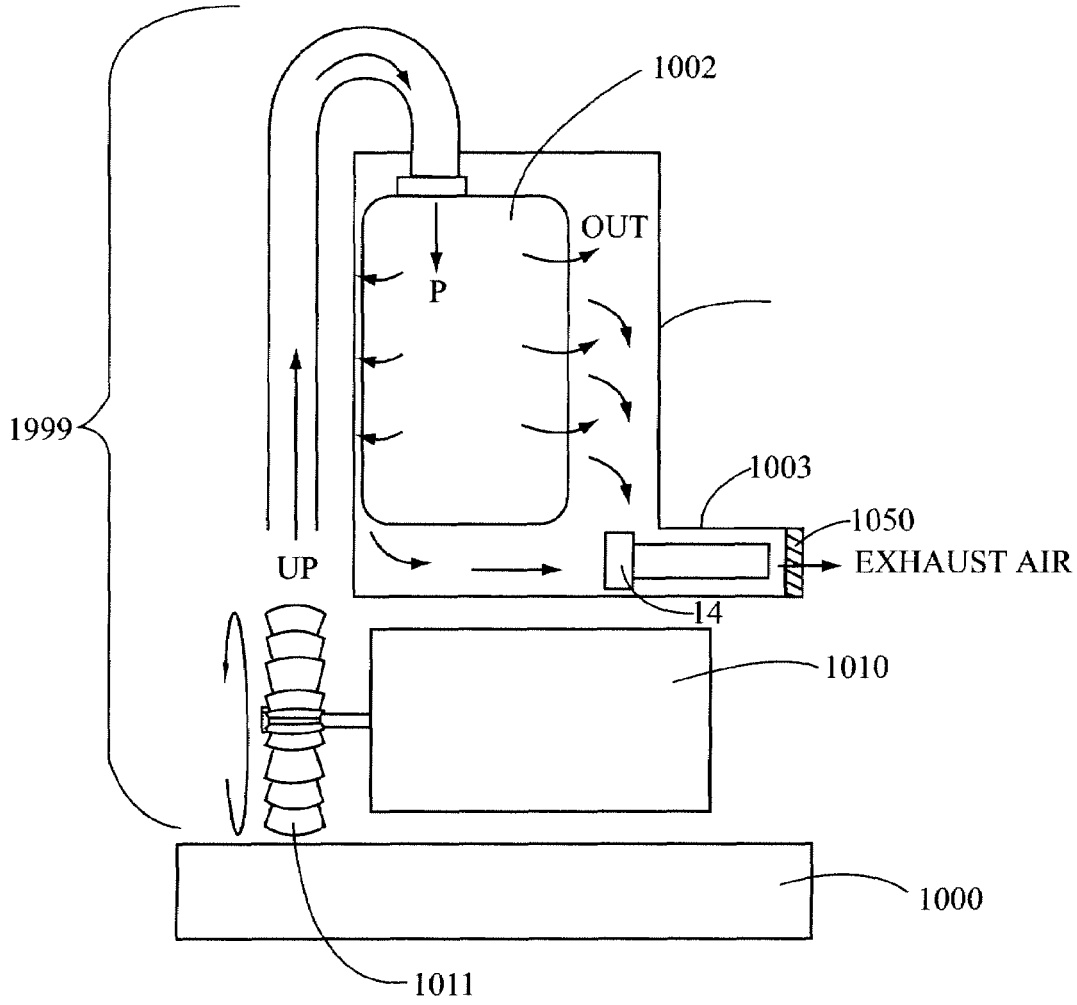
FIG. 11 is a schematic of the air flow of the FIG. 10 embodiment.

Referring next to FIGS. 10, 11 the fan first upright vacuum 1999 has been improved with the addition of an exhaust channel 1003, and an airtight bag housing 1001. Bag housing 1001 could be a plastic shell or an outer bag with an exhaust channel 1003. The UV light and ionizer 14 is placed in the exhaust channel 1003. Also a silver nitrite treated exhaust air filter 1050 is a further option.

The typical air flow is motor 1010 spins fan 1011 clockwise C. Dirty air from the base 1000 and roller 31 travels via arrow UP into the bag at arrow P. The air then exits the bag 1002 at arrows OUT, and then exits to ambient via the exhaust channel 1003.

Figure 12:
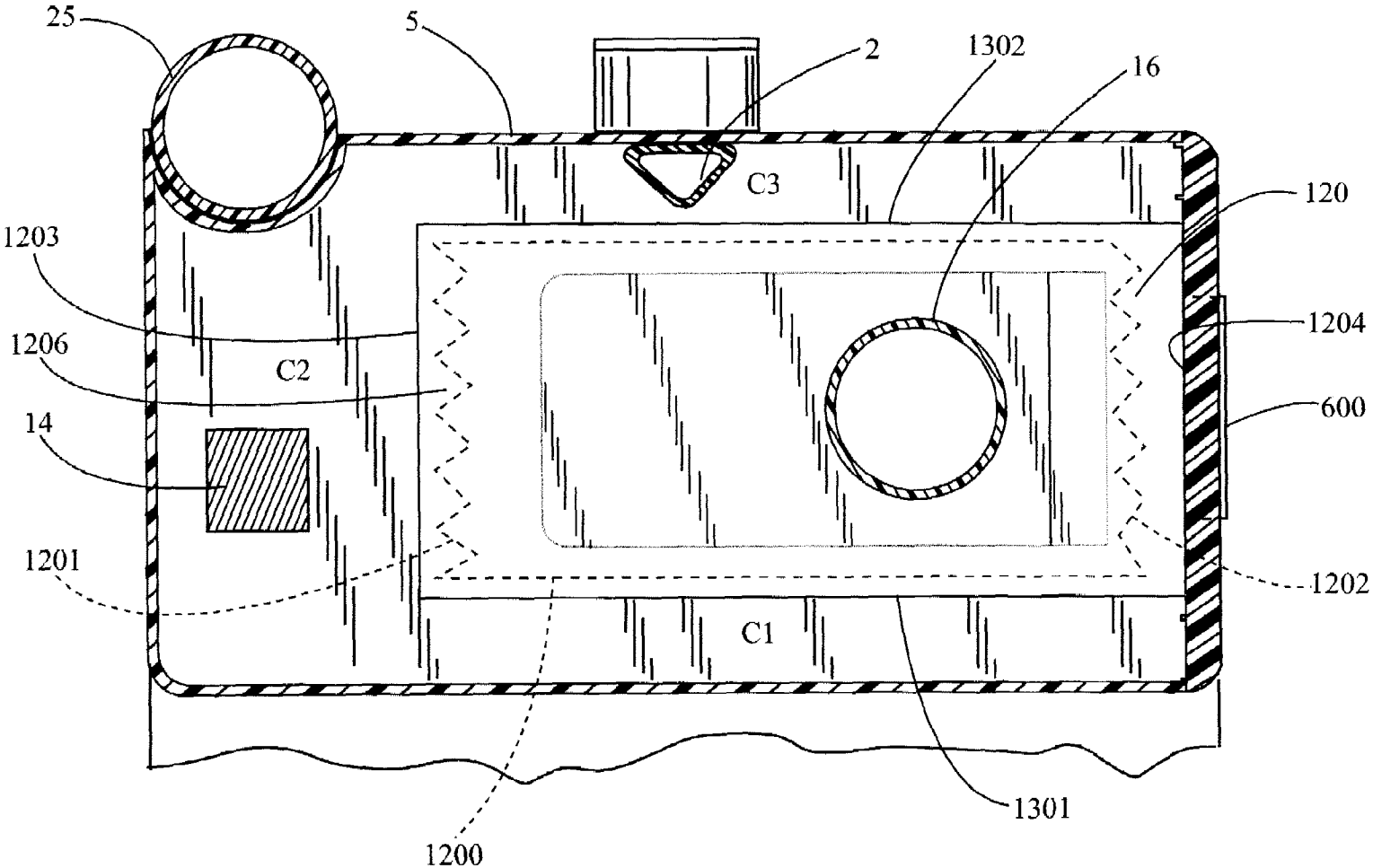
FIG. 12 is a similar view to FIG. 4 with an alternate embodiment accordion type bag.

Referring next to FIG. 12 an alternate design for the bag of the FIG. 2 vacuum is shown. The chamber around the bag with sides 1203, 1205, 1301, 1302 is rectangular. The bag 1367 has accordion sides 1201, 1202 which form increased suction in gaps 1206, 1205 due to the added area of suction along the bag sides 1201, 1202.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. An upright vacuum cleaner comprising:
an upright chassis;
a suction head;
a bypass air flow system which forms a vacuum around a plurality of surfaces of a bag; and
wherein the bag is surrounded by a suction chamber having at least one wall separating the bag from an outer wall of the vacuum cleaner; and
wherein the one wall at least is an accordion shaped exit panel.

2. The apparatus of claim 1, wherein the bypass air flow system further comprises a germ killing light.

3. The apparatus of claim 1, wherein the bag further comprises an antimicrobial therein.

4. The apparatus of claim 1, wherein the cleaner further comprises an output path having an output filter.

5. The apparatus of claim 1, wherein the suction head further comprises a base with a motorized brush roller.

6. The apparatus of claim 4, wherein the output filter further comprises an antimicrobial therein.

7. The apparatus of claim 1, wherein the suction chamber further comprises at least three walls separating the bag from the outer wall of the vacuum chamber.

8. The apparatus of claim 5, wherein the upright chassis further comprises a diverter valve which diverts suction to a wand when a handle is in a vertical position, and diverts suction to the suction head when the handle is in either a tilted or horizontal to the floor position.

9. The apparatus of claim 1, wherein the bag further comprises an accordion shaped exit side.

10. An upright vacuum cleaner comprising:
an upright chassis;
a suction head;
a bypass air flow system which forms a vacuum around a plurality of surfaces of a bag;
wherein the bag is surrounded by a suction chamber having at least one wall separating the bag from an outer wall of the vacuum cleaner;
wherein the suction chamber further comprises at least three walls separating the bag from the outer wall of the vacuum chamber; and
wherein at least one of the at least three walls is an accordion shaped exit panel.

11. The apparatus of claim 7, wherein the suction chamber has a side door providing access to the bag which is a disposable bag.

12. An upright vacuum cleaner comprising:

an upright chassis;

a suction head;

a bypass air flow system which forms a vacuum around a plurality of surfaces of a bag;

a germ killing light in an output path of a flow of exhaust air; and wherein the bag is surrounded by a suction chamber having at least one accordion shaped exit panel.

13. The apparatus of claim 1, wherein the suction chamber further comprises four walls separating the bag from the outer wall of the vacuum chamber.

* * * * *